US009784116B2

(12) United States Patent
Hafner et al.

(10) Patent No.: US 9,784,116 B2
(45) Date of Patent: Oct. 10, 2017

(54) TURBINE SHROUD ASSEMBLY

(71) Applicant: General Electric Company, Schenectady, NY (US)

(72) Inventors: Matthew Troy Hafner, Honea Path, SC (US); Victor John Morgan, Greenville, SC (US); Frederic Woodrow Roberts, Jr., Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 283 days.

(21) Appl. No.: 14/597,772

(22) Filed: Jan. 15, 2015

(65) Prior Publication Data

US 2016/0208633 A1 Jul. 21, 2016

(51) Int. Cl.
*F01D 11/08* (2006.01)
*F01D 25/24* (2006.01)

(52) U.S. Cl.
CPC ..... *F01D 11/08* (2013.01); *F01D 25/246* (2013.01); *F05D 2230/60* (2013.01); *F05D 2230/90* (2013.01); *F05D 2240/11* (2013.01); *F05D 2300/6033* (2013.01); *F05D 2300/611* (2013.01)

(58) Field of Classification Search
CPC ..... F01D 11/08; F01D 25/246; F01D 11/025; F01D 11/12; F01D 11/122; F05D 2230/60; F05D 2230/90; F05D 2240/11; F05D 2300/6033; F05D 2300/611
USPC ..... 415/173.1
See application file for complete search history.

(56) References Cited

U.S. PATENT DOCUMENTS 1,452,602 A 5/1921 Herr
3,147,952 A * 9/1964 Ladner ..... F01D 25/246 415/136
3,788,767 A * 1/1974 Bednarczyk ..... F01D 25/246 415/209.2
3,825,364 A * 7/1974 Halila ..... F01D 11/12 165/907
5,474,417 A * 12/1995 Privett ..... F04D 29/526 415/173.1
5,772,400 A * 6/1998 Pellow ..... F01D 11/24 415/173.1
6,758,653 B2 * 7/2004 Morrison ..... F01D 9/04 415/116
7,587,818 B2 9/2009 Gorman et al.
7,997,874 B2 8/2011 Van der Bos
8,047,773 B2 * 11/2011 Bruce ..... F01D 25/04 415/173.3
8,246,299 B2 * 8/2012 Razzell ..... F01D 11/005 415/116

(Continued)

*Primary Examiner* — Aaron R Eastman
(74) *Attorney, Agent, or Firm* — Dority & Manning, PA

(57) ABSTRACT

A turbine shroud assembly includes a plurality of arcuate shroud block assemblies annularly arranged to form a shroud segment. The plurality of shroud block assemblies includes a first shroud block assembly having a shroud block and a second shroud block assembly having a shroud block. The first shroud block assembly includes a seal interface member and a shroud seal. The seal interface member has a side portion that is adjacent to a radial side surface of the first shroud block. The second shroud block assembly includes a seal interface member and a shroud seal. The seal interface member has a side portion that is adjacent to a radial side surface of the second shroud block.

11 Claims, 5 Drawing Sheets

(56) References Cited

U.S. PATENT DOCUMENTS

| | | | | |
|---|---|---|---|---|
| 8,250,756 | B2 | 8/2012 | Adis et al. | |
| 2007/0031258 | A1* | 2/2007 | Campbell | F01D 9/04 416/189 |
| 2008/0267770 | A1* | 10/2008 | Webster | F01D 11/005 415/173.1 |
| 2008/0279678 | A1* | 11/2008 | Merrill | F01D 9/06 415/173.4 |
| 2009/0010755 | A1* | 1/2009 | Keller | F01D 21/045 415/197 |
| 2009/0250155 | A1* | 10/2009 | Orberg | F01D 5/005 156/95 |
| 2010/0050408 | A1* | 3/2010 | Minor | B23P 6/005 29/402.13 |
| 2011/0058953 | A1 | 3/2011 | Simon-Delgado et al. | |
| 2012/0020770 | A1* | 1/2012 | Rogers | F01D 5/26 415/119 |

* cited by examiner

TURBINE SHROUD ASSEMBLY

FIELD OF THE INVENTION

The present invention generally relates to a turbine shroud assembly for a turbomachine. More particularly, this invention relates to a turbine shroud assembly having a seal interface member.

BACKGROUND OF THE INVENTION

A turbomachine, such as a gas turbine or steam turbine generally includes a turbine and a rotor shaft that extends axially through the turbine section. In particular configurations, the turbine includes multiple turbine blades that extend radially outwardly from the rotor shaft. An inner casing or shell circumferentially surrounds the turbine blades and includes a turbine shroud assembly. The turbine shroud assembly generally includes multiple shroud blocks that are annularly arranged along an inner surface of the inner casing. Each shroud block assembly includes one or more shroud seals coupled thereto, and each shroud seal includes a sealing side or surface. A radial gap is defined between a tip portion of the turbine blades and the sealing surfaces of the shroud seals.

Typically, seals are provided within a joint that is formed between radial side surfaces of adjacent shroud blocks. The seals prevent and/or reduce leakage of combustion gases, steam and/or cooling air through the radial joint. During assembly, the seals may bind and/or become misaligned. If this occurs, the shroud seals of the adjacent shroud blocks may unintentionally load against each other. In certain instances, such as where the shroud seals are formed from ceramic composite materials, this unintentional loading may result in undesirable stresses on the shroud seals. Therefore, an improved turbine shroud assembly would be useful.

BRIEF DESCRIPTION OF THE INVENTION

Aspects and advantages of the invention are set forth below in the following description, or may be obvious from the description, or may be learned through practice of the invention.

One embodiment of the present invention is a turbine shroud assembly. The turbine shroud assembly includes a plurality of arcuate shroud block assemblies that are annularly arranged to form a shroud segment. The plurality of shroud block assemblies includes a first shroud block assembly having a shroud block that defines a radial side surface, and a second shroud block assembly having a shroud block that defines a radial side surface. The first shroud block assembly further comprises a seal interface member and a shroud seal that are coupled to the first shroud block such that a side portion of the seal interface member is adjacent to the radial side surface of the first shroud block. The second shroud block assembly further comprises a seal interface member and a shroud seal that are coupled to the second shroud block such that a side portion of the seal interface member is adjacent to the radial side surface of the second shroud block.

Another embodiment of the present invention is a turbine shroud assembly. The turbine shroud assembly includes a plurality of arcuate shroud block assemblies that are annularly arranged to form a continuous shroud ring. The plurality of shroud block assemblies includes a first shroud block assembly having a first shroud block that defines a first radial side surface, and a second shroud block assembly that is adjacent to the first shroud block assembly. The second shroud block assembly includes a second shroud block. The second shroud block defines a second radial side surface. A joint is defined between the first and second radial side surfaces. The first shroud block assembly further comprises a seal interface member and a shroud seal that are coupled to an inner surface of the first shroud block. The seal interface member has a side portion that is adjacent to the radial side surface of the first shroud block. The second shroud block assembly further comprises a seal interface member and a shroud seal that are coupled to an inner surface of the second shroud block. The seal interface member also having a side portion that is adjacent to the radial side surface of the second shroud block. The side portion of the seal interface member of the first shroud block assembly and the side portion of the seal interface member of the second shroud block assembly are adjacent.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
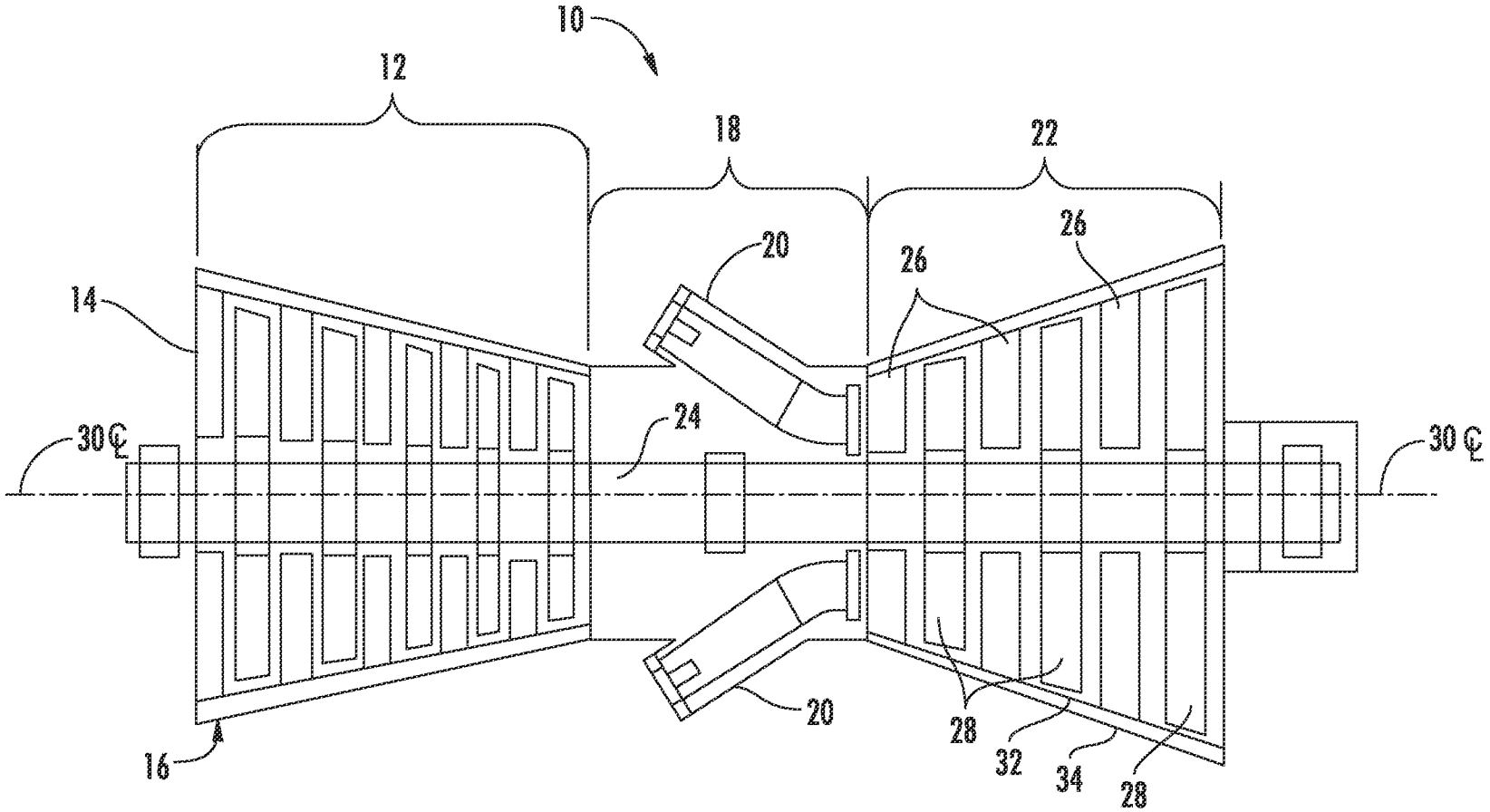
FIG. 1 (PRIOR ART)
FIG. 1 is a cross sectioned view of an exemplary turbomachine, particularly a gas turbine turbomachine as may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to the drawings, FIG. 1 illustrates a cross section of side view of an exemplary turbomachine, particularly a gas turbine 10 turbomachine as may incorporate various embodiments of the present invention. As shown, the gas turbine 10 generally includes a compressor section 12 having an inlet 14 disposed at an upstream end of an axial compressor 16. The gas turbine 10 further includes a combustion section 18 having one or more combustors 20 positioned downstream from the compressor 16, and a turbine section 22 downstream from the combustion section 18. A rotor shaft 24 extends generally axially through the gas turbine 10. The turbine section 22 generally includes alternating stages of stationary nozzles 26 and turbine rotor blades 28 positioned within the turbine section 22 along an axial centerline 30 of the shaft 24. An inner casing or shell 32 circumferentially surrounds the alternating stages of stationary nozzles 26 and the turbine rotor blades 28. An outer casing or shell 34 circumferentially surrounds the inner casing 32.

Figure 2:
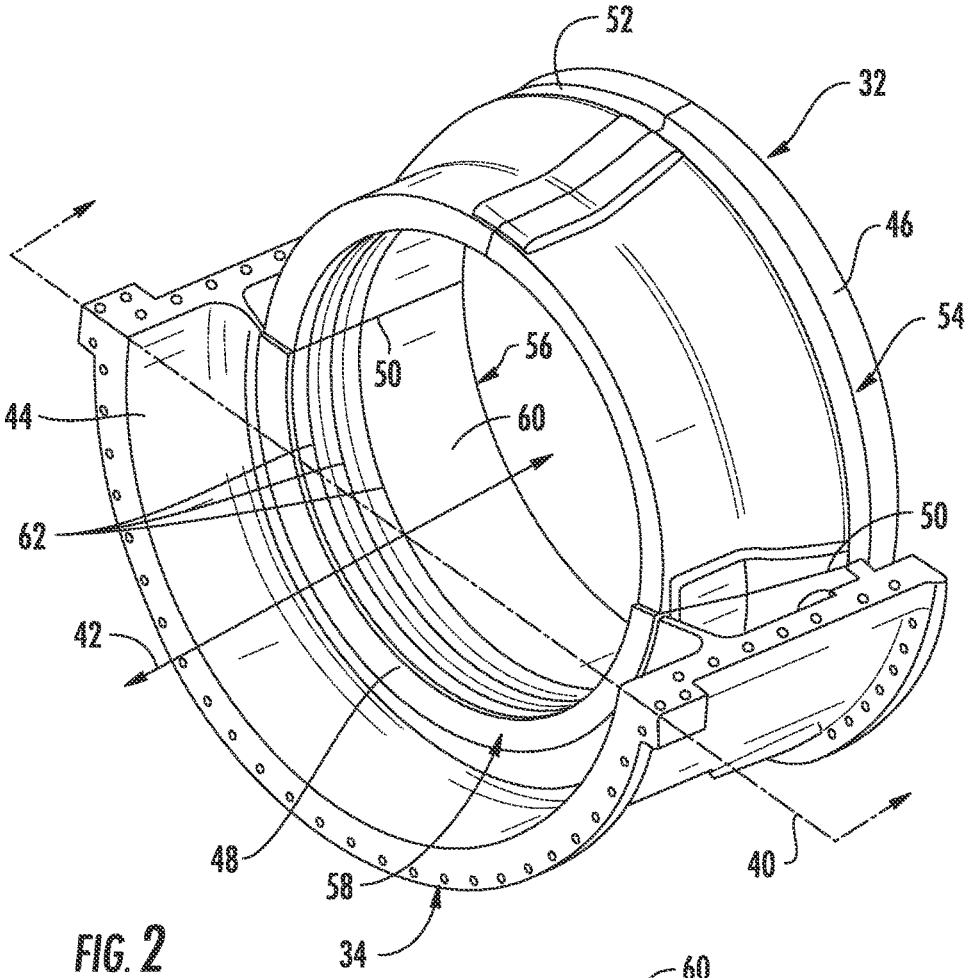
FIG. 2 a perspective view of an exemplary inner and outer casing of a turbomachine as may be incorporated in various embodiments of the present invention.

FIG. 2 provides a perspective view of the inner and the outer casings 32, 34. Typically, as shown in FIG. 2, the inner easing 32 and the outer casing 34 are split along a horizontal plane 40 that extends parallel to a common axial centerline 42 of the inner and the outer casings 32, 34. The outer easing 34 is split into a top portion (removed for clarity) and a bottom portion 44. The top portion may be separated from the bottom portion, for example, by a crane or other lifting device, to access the inner casing 32.

The inner casing 32 is typically split into an upper portion 46 and a lower portion 48 along horizontal plane 40. A horizontal joint 50 is defined between the upper and lower portions 46, 48. The upper portion 46 may be separated from and/or lowered onto the lower portion 48 by a crane or other lifting device to access the lower portion 48 of the inner casing 32 during assembly and/or disassembly. The upper and lower portions 46, 48 may be further split into multiple arcuate sections. For example, as shown in FIG. 2, the upper portion 46 may be split into at least two arcuate sections 52, 54 and the lower portion 48 may be split into at least two arcuate sections 56, 58.

Figure 3:
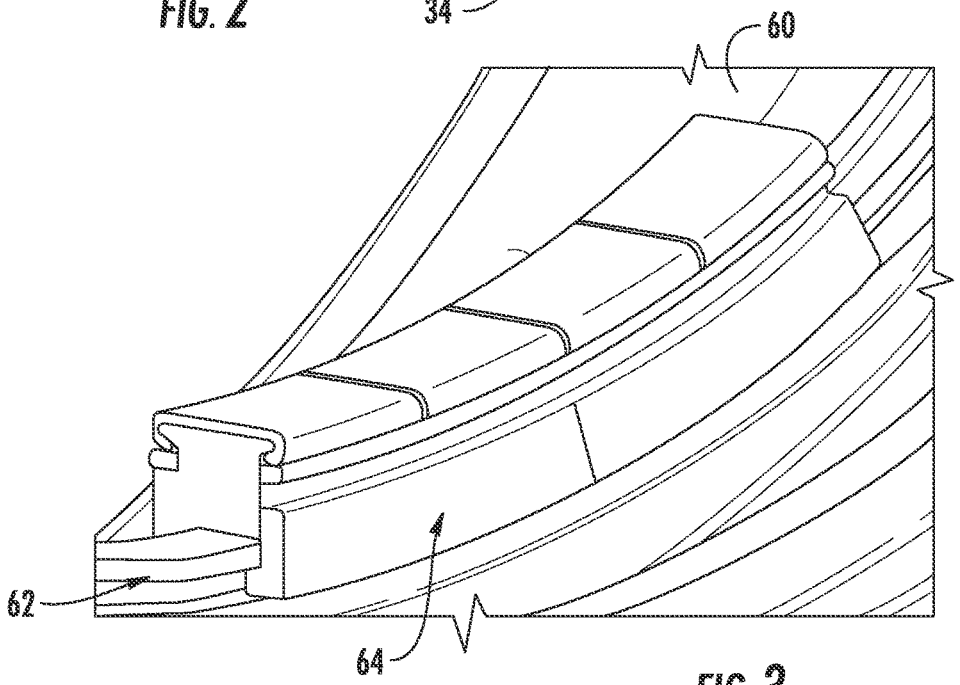
FIG. 3 is a perspective view of a portion of the inner casing as shown in FIG. 2, according to one or more embodiments of the present invention.

FIG. 3 provides a perspective view of a portion of the inner casing 32 according to one or more embodiments. As shown in FIGS. 2 and 3, an inner surface 60 of the inner casing 32 typically defines and/or includes channels, slots hooks or other coupling or mounting features 62. As shown in FIG. 3, the mounting features 62 may be used to attach shroud blocks 64 of a turbine shroud assembly thereto.

Figure 4:
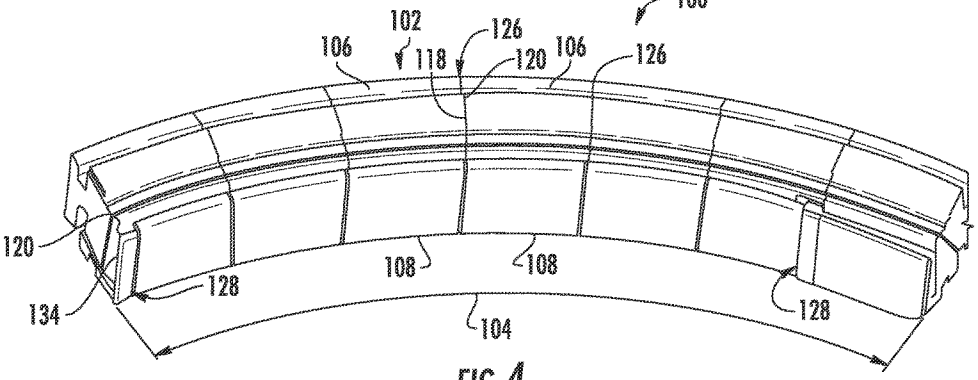
FIG. 4 is a perspective front side view of a portion of an exemplary turbine shroud assembly according to one embodiment of the present invention.

FIG. 4 provides a perspective front side view of a portion of an exemplary turbine shroud assembly 100 according to one embodiment of the present invention. In one embodiment, as shown in FIG. 4, the turbine shroud assembly 100 includes a plurality of arcuate shaped shroud block assemblies 102 annularly arranged to form a shroud segment 104. The turbine shroud assembly 100 may comprise of a single shroud segment 104 or multiple shroud segments 104 coupled together to at least partially form a shroud ring. Each shroud block assembly 102 includes a shroud block 106 and a shroud seal 108 that is coupled and/or mounted to the shroud block 106.

Figure 6:
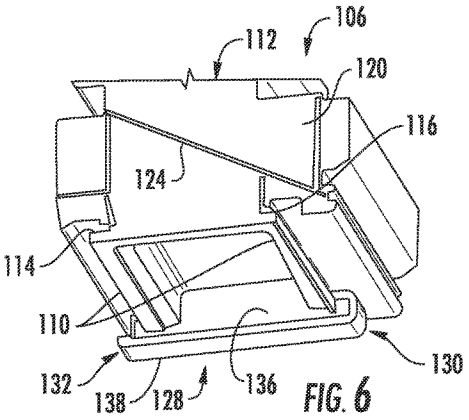
FIG. 6 is a perspective view of an opposing side of a shroud block of a shroud block assembly of the turbine shroud assembly as shown in FIG. 5, according to at least one embodiment of the present invention.
Figure 5:
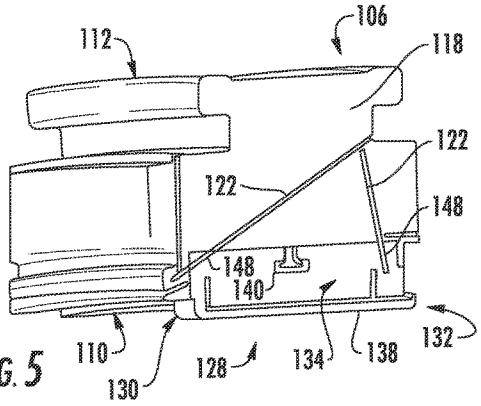
FIG. 5 is a perspective side view of an exemplary shroud block of the turbine shroud assembly as shown in FIG. 4, according to at least one embodiment of the present invention.

FIG. 5 provides a perspective side view of an exemplary shroud block 106 of the turbine shroud assembly 100 as shown in FIG. 4, according to at least one embodiment of the present invention. FIG. 6 provides a perspective view of an opposing side of the shroud block 106 of the turbine shroud assembly 100 as shown in FIG. 5, according to at least one embodiment of the present invention. As shown in FIGS. 5 and 6, the shroud block 106 generally includes an arcuate inner surface 110 that is radially separated from an arcuate outer surface 112. The outer surface 112 is configured to couple or connect to the mounting feature 62 of the inner surface 60 of the inner casing 32. The inner surface 110 is configured to receive and/or connect to the shroud seal 108 (FIG. 4). For example, as shown in FIG. 6, the inner surface 110 may include and/or define arcuate slots or grooves 114, 116.

As shown in FIGS. 5 and 6 collectively, the shroud block 106 also includes and/or defines circumferentially opposing radial side surfaces 118, 120. The radial sides or surfaces 118, 120 may be generally configured in the same manner. For example, in one embodiment, at least one of the radial side surfaces 118, 120 includes and/or defines a seal slot 122, 124. The radial side surfaces 118, 120 may be substantially planer. As shown in FIG. 4, joints 126 are formed between the radial side surfaces 118, 120 of adjacent shroud blocks 106.

In particular embodiments, as shown in FIGS. 4, 5 and 6, at least one shroud block assembly 106 includes a seal interface member 128. The seal interface member 128 may be used to retain the shroud seals 108 in-situ during assembly and disassembly of the turbine shroud assembly 100 and/or the inner casing 32.

As shown in FIGS. 5 and 6, an exemplary seal interface member 128 includes a leading edge 130 portion, a trailing edge portion 132, a radial side portion 134 (FIG. 5), an opposing radial side portion 136 (FIG. 6) and a seal surface 138. In particular embodiments, as shown in FIG. 4, radial side portion 134 is adjacent to and/or with radial side surface 120.

In one embodiment, as illustrated in FIG. 5, radial side portion 134 is adjacent to and/or with radial side surface 118. The radial side portion 134 may be contiguous with, planer to or flush with the corresponding radial side surface 118, 120. In other embodiments, the radial side portion 134 may extend outwardly from the outer radial side surface 118, 120. In one embodiment, the seal interface member 128 is formed from a first material and the shroud seal 108 is formed from a second material that is different from the first material. For example, in one embodiment, the first material comprises a high temperature alloy and the second material comprises a ceramic matrix composite material. In particular embodiments, the seal interface member 128 may be formed or cast as an integral component or feature of the shroud block 106.

Figure 7:
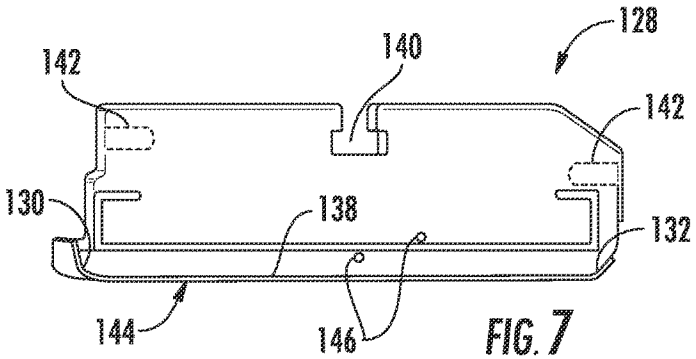
FIG. 7 is a side view of an exemplary seal interface member according to various embodiments.

FIG. 7 provides a side view of the seal interface member 128 according to various embodiments. In particular embodiments, as shown in FIG. 7, the seal interface member 128 may include one or more slots 140 for mounting or coupling the seal interface member 128 to the shroud block 106. In addition or in the alternative, the seal interface member 128 may include pin or fastener holes 142 for securing the seal interface member 128 to the shroud block 106.

In particular embodiments, the seal surface 138 of the seal interface member 128 may include a coating 144 such as a thermal barrier coating and/or a wear coating. The coating 144 may extend over the leading edge 130 and/or the trailing edge 132. In one embodiment, the seal interface member 128 includes a plurality of holes or passages 146 which may provide for cooling of the seal interface member 128 during operation of the turbine. In particular embodiments, as shown in FIGS. 5 and 7, the radial side portion 134 of the seal interface member 128 defines at least one seal slot 148. The seal slot 148 may be continuous and/or aligned with seal slot 122, 124 of the shroud block 106.

Figure 8:
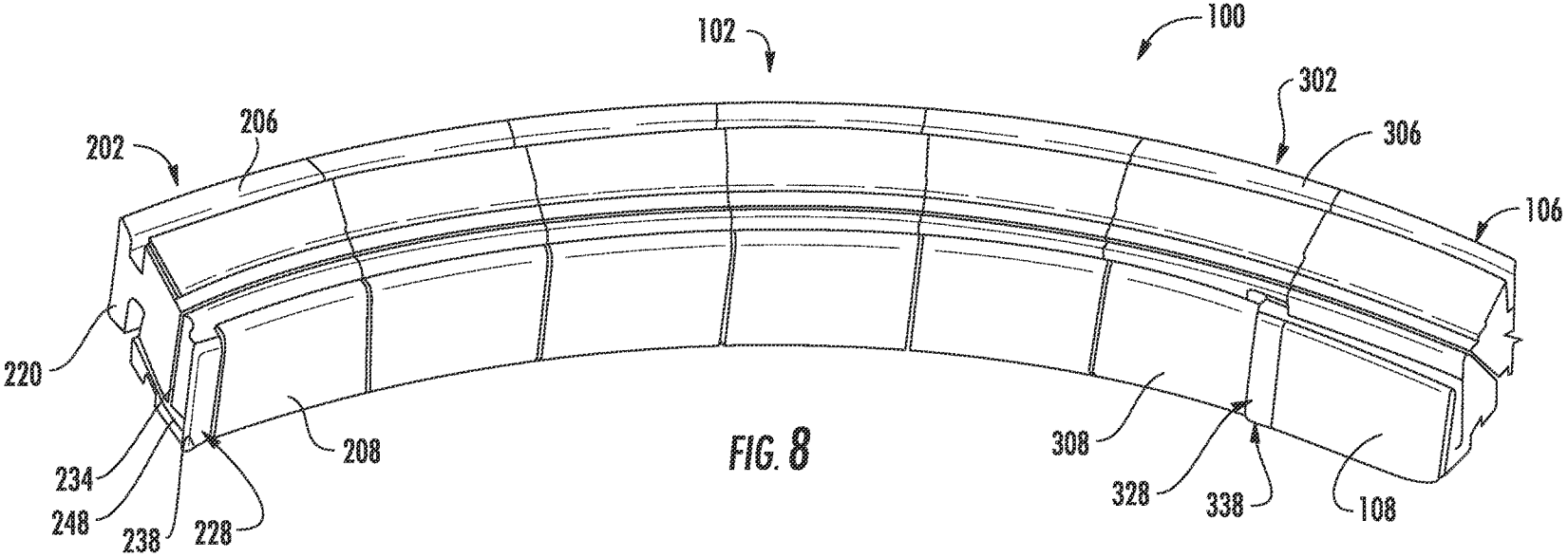
FIG. 8 is a perspective front side view of a portion of the turbine shroud assembly as shown in FIG. 4, according to one embodiment of the present invention.

The turbine shroud assembly 100 may include a plurality of shroud block assemblies 102 which include shroud blocks 106, interface members 128, shroud seals 108 and various other components and features as previously described herein and as illustrated in FIGS. 4, 5, 6 and 7. FIG. 8 provides a perspective front side view of a portion of the turbine shroud assembly 100 as shown in FIG. 4 and FIG. 9 provides a perspective side view of a portion of a shroud block assembly, according to one embodiment of the present invention.

Figure 9:
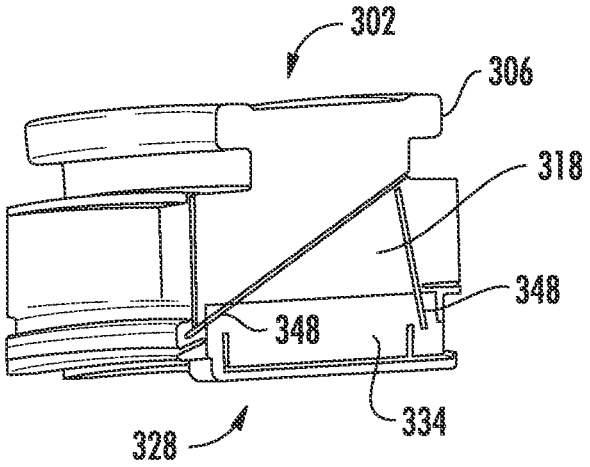
FIG. 9 is a perspective side view of a portion of an exemplary shroud block assembly, according to one embodiment of the present invention.

In one embodiment, as shown in FIG. 8, the plurality of arcuate shroud block assemblies 102 includes a first shroud block assembly 202 having a shroud block 206 that defines radial side surface 220 and a second shroud block assembly 302 having a shroud block 306 that defines radial side surface 318 (FIG. 9). The first shroud block assembly 202 further comprises seal interface member 228 and a shroud seal 208 coupled to the first shroud block 206. Radial side portion 234 of the seal interface member 228 is adjacent to the radial side surface 220 of the first shroud block 206. The second shroud block assembly 302 further comprises seal interface member 328 and shroud seal 308 coupled to the second shroud block 306. As shown in FIG. 9, radial side portion 334 of seal interface member 328 is substantially adjacent to radial side surface 318 of the second shroud block 306.

In one embodiment, as shown in FIG. 8, seal interface member 228 includes a seal surface 238 that is coated with at least one of with at least one of a thermal barrier coating or a wear resistant coating. In one embodiment, as shown in FIG. 8, seal interface member 328 includes a seal surface 338 that is coated with at least one of with at least one of a thermal barrier coating or a wear resistant coating. In one embodiment, the radial side portion 234 of the seal interface member 228 defines seal slot 224. In one embodiment, the radial side portion 234 of the seal interface member 228 defines seal slot 248. In one embodiment, the radial side portion 334 of the seal interface member of the second shroud block assembly defines seal slot 348. In one embodiment, seal interface member 228 and seal interface member 328 are formed from a first material and shroud seal 208 and shroud seal 308 are formed from a second material that is different from the first material. In one embodiment, the first material comprises a high temperature alloy and the second material comprises a ceramic matrix composite material. In one embodiment, the plurality of arcuate shroud block assemblies 102 further includes one or more shroud block assemblies 102 disposed circumferentially between the first shroud block assembly 202 and the second shroud block assembly 302.

Figure 10:
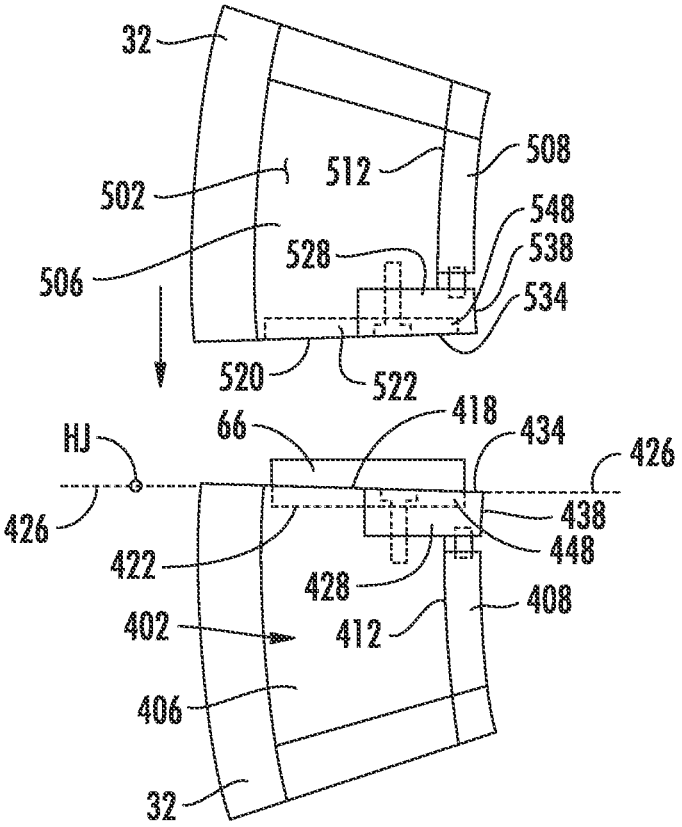
FIG. 10 provides a simplified cross sectioned side view of a portion of a turbine shroud assembly according to one embodiment of the present invention.

FIG. 10 provides a simplified cross sectioned side view of a portion of the turbine shroud assembly 100 according to one embodiment of the present invention. As shown in FIG. 10, a first shroud block assembly 402 includes a first shroud block 406 defining first radial side surface 418 and a second shroud block assembly 502 that is adjacent to first shroud block assembly 402. The second shroud block assembly 502 includes a second shroud block 506 that defines second radial side surface 520. A joint 426 is defined between the first and second radial side surfaces 418, 520. The first shroud block assembly 402 further comprises seal interface member 428 and shroud seal 408 which is coupled to or formed integrally with inner surface 412 of the first shroud block 406. Seal interface member 428 has a radial side portion 434 that is adjacent to radial side surface 418 of first shroud block 406. The second shroud block assembly 502 further comprises seal interface member 528 and shroud seal 508 coupled to inner surface 512 of the second shroud block. Seal interface member 528 has side portion 534 that is adjacent to radial side surface 520 of the second shroud block 506. Side portion 434 of seal interface member 428 and side portion 534 of seal interface member 528 are adjacent and/or circumferentially aligned.

In one embodiment, joint 426 coincides with horizontal joint 50 of the inner casing 32 of the turbomachine 10. In one embodiment, first shroud block assembly 402 is coupled to inner surface 60 of a first arcuate section 52 of turbine inner casing 32 and the second shroud block assembly 502 is coupled to an inner 60 surface of a second arcuate section 54 of the inner casing 32.

In one embodiment, at least one of seal interface member 428 and 528 includes a seal surface 438, 538. In one embodiment, at least one of seal surface 438 and seal surface 538 is at least partially coated with at least one of a thermal barrier coating or a wear resistant coating. In one embodiment, at least one of the side surface 434 of seal interface member 428 and the side surface 534 of seal interface member 528 defines a seal slot 522. In one embodiment, at least one of radial side surface 418 and radial side surface 518 defines a seal slot 448, 548. In one embodiment, a seal 66 extends between radial side surfaces 418 and 520. In one embodiment, seal interface member 428 and seal interface member 528 are formed from a metal and first shroud seal 408 and/or second shroud seal are formed from a ceramic matrix composite material.

The turbine shroud assembly 100 as described and illustrated herein, provides various technical benefits over known turbine shroud assemblies. For example, the seal interface member 128 may reduce undesirable stresses between adjacent shroud seals. This is particularly beneficial in cases where at least one of the shroud seals is formed from a ceramic matrix composite material. In addition, the seal interface member 128 may be used to retain the shroud seals 108 in-situ during assembly and/or disassembly of the inner turbine casing 32. In addition, the seal inter face member 128 may allow for multiple types of shroud seals to be used in a common turbine shroud assembly during test and/or verification by segregating the different shroud seal types from each other, thus isolating potential failures of new or developmental shroud seals from non-developmental shroud seals. The interface member(s) 128 may provide for the adaptation of one seal configuration or seal type in one shroud segment and the adaptation of a different seal configuration or seal type in a separate or adjacent shroud segment. In addition or in the alternative, interface member(s) 128 may provide for post impingement pressure and/or temperature segregation across the interface member, thus acting as a flow dam or barrier to prevent cooling flow from leaking or escaping between adjacent shroud segments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed is:

1. A turbine shroud assembly, comprising:

a first shroud block defining an arcuate inner surface and a radial side surface, the first shroud block comprising a seal slot defined in the radial side surface of the first shroud block;

a first shroud seal having a radial side wall, wherein the first shroud seal is connected to the arcuate inner surface of the first shroud block; and a seal interface member connected to the arcuate inner surface of the first shroud block, the seal interface member having a first radial side portion circumferentially spaced from a second radial side portion and a seal slot defined in the first radial side portion of the seal interface member, the seal slot of the first shroud block continuous with the seal slot of the seal interface member, wherein the first radial side portion is positioned next to the radial side wall of the first shroud seal, the seal interface member further comprising a seal surface.

2. The turbine shroud assembly as in claim 1, wherein the seal surface of the seal interface member is coated with at least one of a thermal barrier coating and a wear coating.

3. The turbine shroud assembly as in claim 1, wherein the seal interface member is formed from a metallic material and the first shroud seal is formed from a ceramic matrix composite material.

4. The turbine shroud assembly as in claim 1, wherein the seal interface member includes a leading edge and a trailing edge, wherein a coating extends over at least one of the leading edge and the trailing edge.

5. The turbine shroud assembly as in claim 1, wherein the seal interface member includes a plurality of holes, wherein the plurality of holes provide for cooling of the seal interface member.

6. The turbine shroud assembly as in claim 1, further comprising a second shroud seal having a radial side wall, wherein the second shroud seal is connected to at least one of the arcuate inner surface of the first shroud block and an arcuate inner surface of a second shroud block, wherein the second shroud block is disposed circumferentially adjacent to the first shroud block, wherein the second shroud seal is positioned adjacent to the second radial side portion of the seal interface member, and wherein the seal interface member circumferentially separates the first shroud seal from the second shroud seal.

7. The turbine shroud assembly as in claim 6, wherein the first shroud block, the first shroud seal and the seal interface member are coupled to an upper portion of an inner casing of a turbine and the second shroud seal is connected to the arcuate inner surface of the second shroud block and the second shroud block is connected to a lower portion of the inner casing of the turbine.

8. The turbine shroud assembly as in claim 7, wherein the seal interface member is a first seal interface member, further comprising a second seal interface member connected to the arcuate inner surface of the second shroud block, the second seal interface member having a radial side surface, and the turbine shroud assembly further comprises a joint defined between the first radial side portion of the first seal interface member and the radial side surface of the second seal interface member, wherein the joint coincides with a horizontal joint of the inner casing of the turbine.

9. The turbine shroud assembly as in claim 8, further comprising a seal extending between the first radial side portion of the first seal interface member and the radial side surface of the second seal interface member.

10. The turbine shroud assembly as in claim 6, wherein the second shroud seal is connected to the arcuate inner surface of the second shroud block, and wherein the first shroud block, the first shroud seal, the seal interface member, the second shroud block and the second shroud seal are coupled to a portion of an inner casing of a turbine.

11. The turbine shroud assembly as in claim 6, wherein the first shroud seal, the seal interface member and the second shroud seal are coupled to a portion of an inner casing of a turbine.

* * * * *